United States Patent [19]

Kasuga et al.

[11] 4,154,128

[45] May 15, 1979

[54] RECORD SHEET CUTTER CONTROL DEVICE

[75] Inventors: Muneo Kasuga; Masaji Nishikawa, both of Hachioji; Noboru Takasugi, Higashi-Yamato, all of Japan

[73] Assignee: Olympus Optical Co., Ltd., Tokyo, Japan

[21] Appl. No.: 835,291

[22] Filed: Sep. 21, 1977

[30] Foreign Application Priority Data

Sep. 28, 1976 [JP] Japan ..... 51/115377

[51] Int. Cl.[2] ..... B26D 5/26

[52] U.S. Cl. ..... 83/205; 83/208; 83/362; 83/369

[58] Field of Search ..... 83/205, 208, 210, 221, 83/211, 265, 362, 367, 369, 372, 371, 364, 365

[56] References Cited

U.S. PATENT DOCUMENTS

| | | | |
|---|---|---|---|
| 2,955,500 | 10/1960 | Krueger | 83/205 |
| 3,533,691 | 10/1970 | Suzuki et al. | 83/205 |
| 3,564,960 | 2/1971 | Foulks | 83/203 |
| 3,743,413 | 7/1973 | Sharp et al. | 83/208 X |
| 3,760,669 | 9/1973 | Rosenthal et al. | 83/208 X |

*Primary Examiner*—Donald R. Schran

*Attorney, Agent, or Firm*—Haseltine, Lake & Waters

[57] ABSTRACT

A record sheet cutter control device which can cut a record sheet after a normal record sheet feeding operation has completely been stopped. The device comprises means for involving a difference in time between a signal for stopping the operation of a record sheet feed roller and a signal for starting the operation of a cutter.

4 Claims, 6 Drawing Figures

RECORD SHEET CUTTER CONTROL DEVICE

BACKGROUND OF THE INVENTION

This invention relates to a record sheet cutter control device for electrographic apparatus and the like, which comprises a roll-shaped record sheet, a record sheet feed roller and a cutter, and which can control the operational timing of the cutter for cutting the record sheet into a required given length.

In such electrographic apparatus and the like which makes use of the roll-shaped record sheet, the record sheet is delivered therefrom by means of the record sheet feed roller and cut into a given length by means of the cutter, thereby using such given length of record sheet. In the above described kind of electrographic apparatus, the given length of record sheet delivered from the roll-shaped record sheet is detected by means of, for example, a microswitch, etc. so as to deliver a signal which functions to stop the feeding operation of the record sheet feed rollers and at the same time to operate the cutter. That is, use is made of an instruction device such as a microswitch which delivers an instruction for not only stopping the feeding operation of the record sheet feed rollers but also operating the cutter.

In the above described conventional device, if the travel speed of the record sheet is not high, even when a cutter blade becomes in touch with the width of the record sheet with a time lag, it is possible to cut the record sheet in a line perpendicular to the side edge thereof, and as a result, that amount of the front end of the record sheet which is bitten onto the cutter blade is not sufficient to cause trouble. But, if the travel speed of the record sheet is high, when the feeding operation of the record sheet feed rollers is stopped at the same time as the operation of the cutter, the cutter becomes operated prior to the complete stop of the record sheet. As a result, the cutter blade becomes in touch with the width of the record sheet with a time lag. This causes the record sheet to be cut along lines other than the line perpendicular to the side edge thereof or causes the front end of the record sheet to bend downwardly along the cutter blade, thereby preventing the next successive record sheet from being normally fed.

SUMMARY OF THE INVENTION

An object of the invention, therefore, is to provide a record sheet cutter control device, which can eliminate the above mentioned drawbacks which have been encountered with the prior art techniques and which can cut a record sheet after a normal record sheet feeding operation has completely been stopped.

A feature of the invention is the provision, in a record sheet cutter control device comprising a roll-shaped record sheet, a record sheet feed roller and a cutter, of the improvement comprising means for involving a difference in time between a signal for stopping the operation of the record sheet feed roller and a signal for starting the operation of the cutter.

The invention will now be described in greater detail with reference to the accompanying drawings.

DESCRIPTION OF THE PREFERRED EMBODIMENTS

Figure 1:
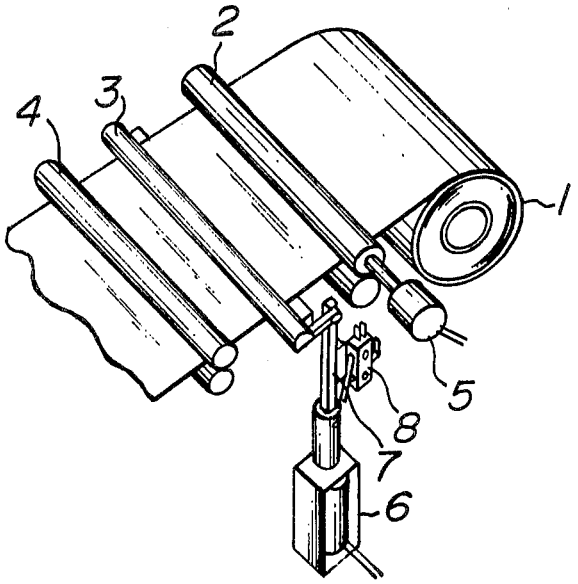
FIG. 1 PRIOR ART
FIG. 1 is a perspective view of one example of a prior art record sheet cutter control device.

In FIG. 1 is shown a prior art record sheet cutter control device which makes use of a roll-shaped record sheet.

A record sheet is delivered from a roll-shaped record sheet 1 by means of a record sheet feed rollers 2 and supplies through a cutter 3 and delivery rollers 4 to an image transfer portion of the record sheet where an image on a photosensitive body is transferred onto the record sheet. The delivery rollers 4 are always rotated by a suitable driving means (not shown). One of the record sheet feed rollers 2 is driven by a driving means through an electrographic clutch (not shown) adapted to be operated by a feed roller solenoid 5. The cutter 3 is composed of an upper movable blade and a lower stationary blade. The upper movable blade is made movable with respect to the lower stationary blade when a cutter solenoid 6 is energized. The cutter solenoid 6 is provided at its movable core with an operating plate 7 for operating a microswitch 8 which is normally made ON and becomes OFF when the cutter 3 is operated.

Figure 2:
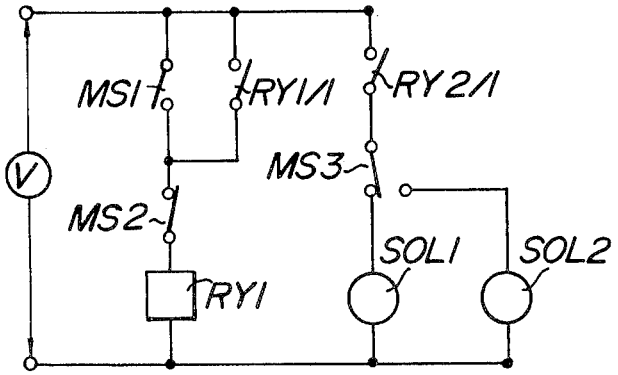
FIG. 2 PRIOR ART
FIG. 2 is a prior art electric circuit diagram of the record sheet cutter control device shown in FIG. 1.

In FIG. 2 is shown a prior art electric circuit of the record sheet cutter control device shown in FIG. 1.

In FIG. 2, SOL1 designates the feed roller solenoid 5 shown in FIG. 1 and SOL2 designates the cutter solenoid 6 shown in FIG. 1. Microswitches MS1, MS2 and a relay RY1 are connected in series across terminals of an electric source V. A relay contact RY1/1 of the relay RY1 is connected in parallel with the microswitch MS1. Across the terminals of the electric source V are connected to solenoids SOL1 and SOL2 through a relay contact RY2/1 of the relay RY1 and a microswitch MS3. Under the normal condition, the microswitch MS1 is made OFF, and the microswitch MS2 is made ON and both the relay contacts RY1/1 and RY2/1 are made OFF. The microswitch MS3 is a two-way switch which is provided with a common arm having one end connected to the relay contact RY2/1 and the other end selectively connected to either one of the solenoids SOL1 and SOL2. The microswitch MS3 is normally connected to the solenoid SOL1.

If the microswitch MS1 is made ON so as to give an instruction of feeding the record sheet, the relay RY1 is energized so close both the relay contacts RY1/1 and RY2/1, thereby closing a self-holding circuit of the relay RY1 through the closed relay contact RY1/1. The closed relay contact RY2/1 causes the feed roller solenoid SOL1 to operate so as to permit the electromagnetic clutch to connect the record sheet feed rollers 2 to the driving means, thereby driving the record sheet feed rollers 2. If the record sheet feed rollers 2 are rotated, the delivery rollers 4 are rotated to deliver the record sheet. When that portion of the record sheet which is delivered from the feed rollers 2 arrives at a given length, the microswitch MS3 becomes operated to change over its common arm from the contact connected to the feed roller solenoid SOL1 to the contact connected to the cutter solenoid SOL2. As a result, the feed roller solenoid SOL1 becomes OFF to disengage the electrographic clutch from the driving means, thereby stopping the record sheet feed rollers 2. On the one hand, the cutter solenoid SOL2 is energized to permit the cutter 3 to cut the record sheet. That portion of the record sheet which is cut is delivered from the normally rotating delivery rollers 4. If the cutter solenoid SOL2 is energized, the record sheet is cut by the cutter 3 and at the same time the operating plate 7 secured to the movable core of the cutter solenoid 6 causes a microswitch 8 which represents the microswitch MS2 to be made OFF. As a result, the relay RY1 is deenergized to make the relay contacts RY1/1 and RY2/1 open, thereby opening the self-holding circuit of the relay RY1 and making both the solenoid SOL1 and SOL2 OFF.

In addition, the microswitch MS3 is changed over and connected to the feed roller solenoid SOL1. This condition is maintained until the microswitch MS1 is made ON again.

In such prior art device, when the microswitch MS3 is changed over from the feed roller solenoid SOL1 to the cutter solenoid SOL2, the cutter 3 becomes operated prior to the complete stop of the record sheet feed rollers 2. As a result, there is a risk of the record sheet being cut along lines other than a line perpendicular to the side edge of the record sheet and, in addition, there is a risk of the front end of the record sheet being bitten onto the cutter blade.

Figure 3:
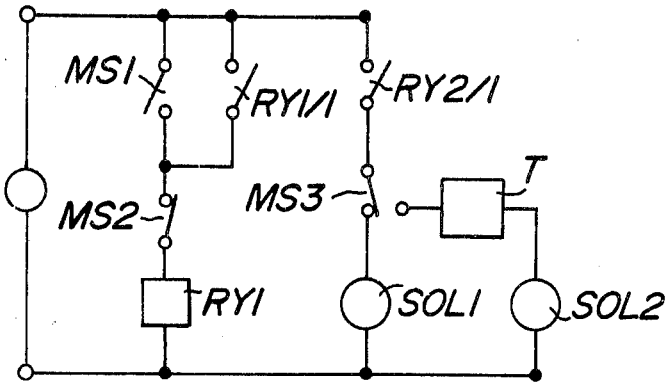
FIG. 3 is an electric circuit diagram of one embodiment of a record sheet cutter control device which makes use of a timer circuit according to the invention.

In FIG. 3 is shown one embodiment a control device according to the invention, which is constructed and arranged such that the above mentioned drawbacks which have been encountered with the prior art device shown in FIG. 2 can be eliminated. In FIG. 3, those circuit elements which function in the same manner as those shown in FIG. 2 are designated by the same reference numerals.

In the present embodiment, between the microswitch MS3 and the cutter solenoid SOL2 is connected in series a timer circuit T.

Similar to the prior art device shown in FIG. 2, if the microswitch MS1 is made ON, the relay RY1 is energized to close both the relay contacts RY1/1 and RY2/1 whereby a self-holding circuit of the relay RY1 is maintained. As a result, the feed roller solenoid SOL1 becomes operated to permit the electromagnetic clutch to connect the record sheet feed rollers 2 to the driving means whereby the record sheet feed rollers 2 are driven by the driving means to deliver the record sheet. If a given length of the record sheet is delivered from the roll-shaped record sheet 1, the microswitch MS3 is changed over from the contact connected to the feed roller solenoid SOL1 to the contact connected through the timer circuit T to the cutter solenoid SOL2. This changed over condition of the microswitch MS3 is kept until the microswitch MS2 becomes OFF. As a result, the feed roller solenoid SOL1 is deenergized to permit the electromagnetic clutch to be disconnected from the driving means whereby the record sheet feed rollers 2 become stopped. On the one hand, the timer circuit T functions to prevent the cutter solenoid SOL2 from being energized immediately after the change-over of the microswitch MS3 and permit the cutter solenoid SOL2 to be energized after a lapse of time within which the record sheet is completely stopped. If the cutter solenoid SOL2 is energized, the record sheet is cut by the cutter 3 and at the same time the operating plate 7 secured to the movable core of the cutter solenoid SOL2 causes the microswitch 8 which represents the microswitch MS2 to be made OFF. As a result, the relay RY1 is deenergized to make both the relay contacts RY1/1 and RY2/1 open, thereby opening the self-holding circuit of the relay RY1 and making both the solenoids SOL1 and SOL2 OFF. In addition, the microswitch MS3 is changed over and connected to the feed roller solenoid SOL1. This condition is maintained until the microswitch MS1 is made ON again.

As seen from the above, the invention is capable of operating the cutter 3 after the record sheet feeding operation has completely been stopped and hence is capable of eliminating the drawbacks that the record sheet is cut along lines not perpendicular to the side edge thereof and that the front end of the record sheet is bitten onto the cutter blade, those drawbacks being inherent to the prior art record sheet cutter control device.

If that travel length of the record sheet which is located between the cutter 3 and the image transfer portion of the record sheet is longer than a given length of the record sheet to be cut, there occurs no problem. But, if the above mentioned travel length is shorter than the given length of the record sheet to be cut, the image transferred onto the record sheet which is cut by the cutter after it has completely been stopped is subjected to strain. As a result, in the latter case, it is necessary to adjust the timer circuit T such that the cutter 3 can be operated after such a time delay that the record sheet can be cut along a line perpendicular to the side edge thereof, that the front end of the record sheet is prevented from being bitten onto the cutter blade, and that the image transfer portion of the record sheet is not subjected to the strain. Thus, it is possible to feed the record sheet under a normal condition.

Figure 4:
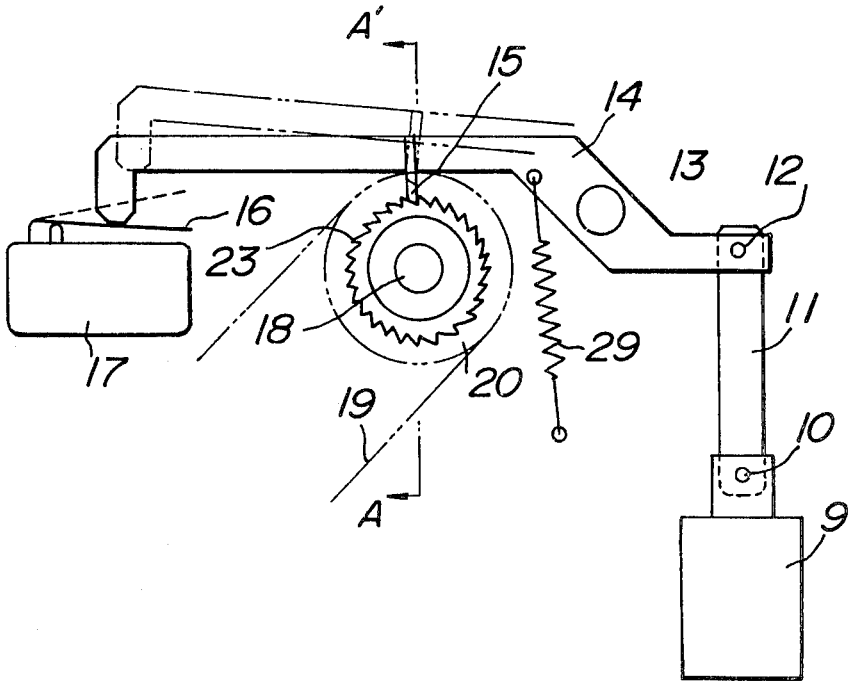
FIG. 4 is a side elevation of another embodiment of a record sheet cutter control device which makes use of a spring clutch mechanism according to the invention.
Figure 5:
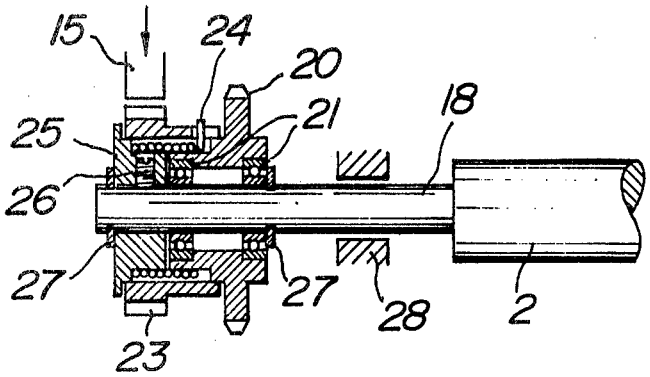
FIG. 5 is a section on line A—A' of FIG. 4.

In FIGS. 4 and 5 is shown another embodiment of a record sheet cutter control device according to the present invention. In the present embodiment, use is made of a spring clutch mechanism instead of the electrographic clutch for the feed roller solenoid 5 (SOL1) shown in FIG. 1.

In the present embodiment, a feed roller solenoid 9 is connected through an arm 11 to a lever 14 pivoted at a pivot 13, the arm 11 having one end pivoted by a pin 10 to the feed roller solenoid 9 and the other end pivoted by a pin 12 to one end of the lever 14. The lever 14 is provided at its intermediate portion between the pivot 13 and the other end of the lever 14 with a pawl 15 and between the pawl 15 and the pivot 13 with a spring 29 for urging the lever 14 in a counterclockwise direction about the pivot 13. To the other end of the lever 14 is opposed an operating plate 16 of a microswitch 17 which is adapted to be operated by the lever 14. The record sheet feed roller 2 (FIG. 1) is provided at its shaft 18 with a spring clutch mechanism adapted to be driven through a chain 19 by a driving means (not shown).

As shown in FIG. 5, the spring clutch mechanism is composed of a sprocket wheel 20 engaged with the chain 19 and rotatably journaled in bearings 21, 21 secured to the shaft 18 of the record sheet feed roller 2. The sprocket wheel 20 is provided at its hub with two stepped portions so as to form large and reduced diameter portions formed concentrically with the shaft 18. On the large diameter portion of the sprocket wheel 20 is mounted an annular ratchet wheel 23 which is provided at its inside with a spring 24 concentrically arranged with the shaft 18. The spring 24 is wound around the reduced diameter portion of the sprocket wheel 20. One end of the spring 24 is extended through a hole formed in the ratchet wheel 23 so as to function as a stopper whereby the position of the spring 24 relative to the ratchet wheel 23 in its rotational direction is made constant.

The spring 24 is wound around the reduced diameter portion of the sprocket wheel 20 in a direction which is opposite to the rotational direction of the sprocket wheel 20 viewed from the side of the record sheet feed roller 2. A front end portion of the spring 24 is wound around one portion of a boss 25 secured to the roller shaft 18. The ratchet wheel 23 is rotatably journaled on a portion of the boss 25 and on the large diameter portion of the hub of the sprocket wheel 20. The boss 25 is secured to the roller shaft 18 by means of a pin 26 so as to be rotated together with the roller shaft 18. Reference numeral 27 designates a thrust collar adapted to prevent the bearings 21, 21 and boss 25 from being axially displaced and 28 is a bearing for rotatably supporting the roller shaft 18.

As shown in FIG. 4, the lever 4 is normally pulled downwardly by means of the spring 29 so as to bring the pawl 15 into engagement with the ratchet wheel 23.

If the feed roller solenoid 9 is made OFF, the pawl 15 engages with the ratchet wheel 23 to prevent rotation of the ratchet wheel 23. At the same time, rotation of the spring 24 is also stopped. As a result, the driving force transmitted from the chain 19 to the sprocket wheel 20 is not transmitted to the roller shaft 18 and hence the roller shaft 18 is stopped. In this case, the microswitch 17 is made ON, the operation of which will be described later.

If the feed roller solenoid 9 is made ON, the arm 11 is pulled downwardly against the action of the spring 29 and hence the lever 14 is rotated in a clockwise direction about the pivot 13 to a position shown by dotted lines, thereby disengaging the pawl 15 from the ratchet wheel 23. As a result, the driving force transmitted from the chain 19 to the sprocket wheel 20 is transmitted through the spring 24, boss 25 and shaft 18 to the record sheet feed roller 2, thereby rotating the record sheet feed roller 2. In this case, the microswitch 17 is made OFF.

If the solenoid 9 is made OFF again, the spring 29 functions to pull the lever 14 downwardly so as to bring the pawl 15 into engagement with the ratchet wheel 23. As a result, the rotation of the ratchet wheel 23 is gradually retarded. If the pawl 15 becomes completely engaged with the ratchet wheel 23, the ratchet wheel 23 becomes stopped. As a result, the spring clutch mechanism functions to stop the record sheet feed roller 2 and at the same time the microswitch 17 becomes ON. Thus, it is possible to control the rotation of the record sheet feed roller 2 by making the feed roller solenoid 9 ON and OFF.

Figure 6:
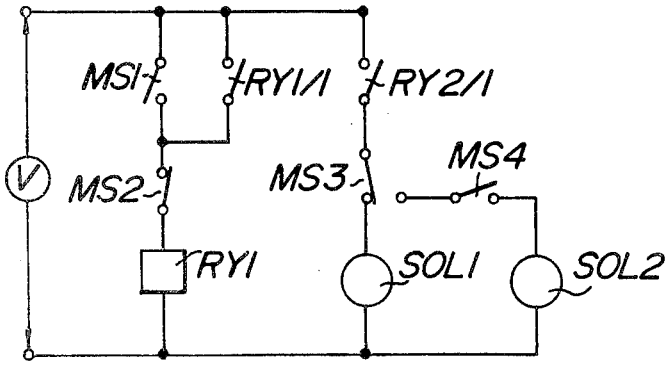
FIG. 6 is an electric circuit diagram of the record sheet cutter control device shown in FIGS. 4 and 5 according to the invention.

In FIG. 6 is shown an embodiment of an electric circuit of a record sheet cutter control device according to the invention for controlling the cutter with the aid of the above described spring clutch mechanism.

In the present embodiment, microswitches MS1, MS2, relay RY1, and relay contacts RY1/1, RY2/1 are connected in the same manner as in the electric circuit shown in FIG. 3. The feed roller solenoid 9 shown in FIG. 4 is connected as the feed roller solenoid SOL1 and between the cutter solenoid SOL2 and the microswitch MS3 is connected the microswitch 17 shown in FIG. 4 as a microswitch MS4 instead of the timer circuit T shown in FIG. 3.

In the present embodiment, when the circuit is not operated, the microswitches MS1, MS4 and the relay contacts RY1/1, RY2/1 are made OFF and the microswitch MS2 is made ON. The microswitch MS3 is selectively connected to the feed roller solenoid SOL1.

If the microswitch MS1 is made ON, the relay RY1 is energized to make the relay contacts RY1/1, RY2/1 ON, respectively. The relay contact RY1/1 functions to maintain a self-holding circuit of the relay RY1. If the relay contact RY2/1 is made ON, the feed roller solenoid SOL1 (the feed roller solenoid 9 shown in FIG. 4) is energized to disengage the pawl 15 from the ratchet wheel 23 thus rotating the record sheet feed roller 2. When a given length of the record sheet is delivered from the record sheet feed roller 2, the microswitch MS3 is operated to change over its contact arm from the feed roller solenoid SOL1 to the cutter solenoid SOL2 to make the feed roller solenoid SOL1 OFF. At this instant, the record sheet feed roller 2 is still rotated, but if the pawl 15 of the lever 14 becomes completely engaged with the ratchet wheel 23, the rotation of the ratchet wheel 23 is stopped, thereby stopping the rotation of the record sheet feed roller 2. At the same time, the lever 14 causes the microswitch 17 (MS4 shown in FIG. 6) to be made ON. As a result, the cutter solenoid SOL2 is energized from the electric source V through the relay contact RY2/1 and microswitches MS3, MS4. As soon as the cutter solenoid SOL2, that is, the cutter solenoid 6 is energized, the cutter 3 becomes operated to cut the record sheet.

As seen from the above, when the record sheet becomes substantially stopped, the microswitch MS4 (microswitch 17 shown in FIG. 4) becomes ON and the cutter solenoid SOL2 causes the cutter 3 to operate. As a result, it is possible to cut the record sheet along a line perpendicular to the side edge thereof and there is no risk of the front end of the record sheet being bitten onto the cutter blade.

In addition, when the cutter solenoid SOL2 is operated, the microswitch MS2 (the microswitch 8 shown in FIG. 1) becomes OFF to deenergize the relay RY1. As a result, both the solenoids SOL1 and SOL2 become OFF and both the microswitches MS3 and MS4 are returned to their original conditions. If the microswitch MS1 is made ON again, the above described record sheet feeding operation will be repeated.

The use of the spring clutch mechanism described above provides the advantage that the spring clutch mechanism is cheaper than the timer T shown in FIG. 3, and that the cutter 3 becomes operated on the instant when the record sheet has substantially stopped irrespective of the distance from the cutter position to the image transfer position of the record sheet and of the length of the record sheet, so that the retardation time can easily be adjusted without involving any troublesome adjustment contrary to the timer circuit.

In addition, if the rotating speed of the record sheet feed roller 2 and hence the travel speed of that portion of the record sheet which is located in the rear of the cutter 3 is made slightly higher than the rotating speed of the delivery roller 4 and hence the travel speed of that portion of the record sheet which is located in front of the cutter 3, that portion of the record sheet which is located between the cutter 3 and the delivery roller 4 is folded into a loop. As a result, the record sheet feeding operation becomes stopped, so oscillation, etc. induced in the record sheet when it is cut by the cutter 3 is not transmitted to the image transfer portion of the record sheet, whereby it is possible to eliminate the bad influence of such oscillations upon the image transfer portion of the record sheet. In addition, since the record sheet feeding operation can forcedly be stopped, it is possible to eliminate out of synchronism between the image transfer portion of the photosensitive body and the picture image forming portion of the record sheet.

The invention is not limited to the above embodiments and various modifications and alternations may be made. The invention may be applied not only to the roll-shaped record sheet of the electrographic apparatus, but also to the roll-shaped record sheet of any other apparatus, for example, a facsimile receiver.

The invention is capable of speeding up the travel speed of the record sheet and hence of speeding up the operation of the electrographic apparatus and the like.

What is claimed is:

1. A record sheet cutter control device comprising: a sprocket wheel rotatably mounted on a roller shaft of a record sheet feed roller, spring means for transmitting a driving force subjected to said sprocket wheel from a chain to said roller shaft, a ratchet wheel having a constant positional relationship with respect to a rotational direction of said spring means, a lever with a pawl engaging said ratchet wheel, a solenoid for operating said lever, said solenoid controlling the rotations of said record sheet feed roller, and a microswitch operated by said lever, said pawl engaging said ratchet wheel substantially stopping the rotation of said record sheet feed roller and obtaining a signal for starting operation of a cutter from said microswitch.

2. The device according to claim 1, wherein a feeding speed of that portion of said record sheet which is located in the rear of said cutter is made slightly higher than a feeding speed of that portion of said record sheet which is located in front of said cutter for eliminating lack of uniformity of said record sheet feeding operation to occur during the interval between the time of stopping said record sheet feeding operation and the time of cutting said record sheet.

3. A record sheet cutter control device as defined in claim 1 wherein said record sheet is cut in a direction perpendicular thereto and free from cutting it in an inclined direction, said record sheet being cut after the record sheet has completely been stopped.

4. A record sheet cutter control device as defined in claim 2 wherein said record sheet is cut in a direction perpendicular thereto and free from cutting it in an inclined direction, said record sheet being cut after the record sheet has completely been stopped.

* * * * *